US005085256A

United States Patent [19]

Kircher et al.

[11] Patent Number: 5,085,256

[45] Date of Patent: Feb. 4, 1992

[54] DRIFT STABILIZATION CHECK

[75] Inventors: Joseph J. Kircher, Palatine; Jane M. Zeisloft, Barrington; James Martucci, Libertyville, all of Ill.

[73] Assignee: Clintec Nutrition Co., Deerfield, Ill.

[21] Appl. No.: 500,915

[22] Filed: Mar. 29, 1990

[51] Int. Cl.[5] ..... B65B 3/28

[52] U.S. Cl. ..... 141/083; 141/104; 141/105; 141/1

[58] Field of Search ..... 141/1, 83, 104, 105, 141/106, 107

[56] References Cited

U.S. PATENT DOCUMENTS 4,372,100 2/1983 Miller et al. ..... 141/105 X
4,635,825 1/1987 Tulasne ..... 141/105 X
4,718,467 1/1988 DiGianfillippo et al. ..... 141/105
4,789,014 12/1988 DiGianfillippo et al. ..... 141/83
4,807,676 2/1989 Cerny et al. ..... 141/98
4,922,975 5/1990 Polaschegg ..... 141/104

*Primary Examiner*—Ernest G. Cusick
*Attorney, Agent, or Firm*—Hill, Van Santen, Steadman & Simpson

[57] ABSTRACT

A device for accurately transferring fluids from a plurality of source containers to a receiving container including a removable transfer set providing fluid communication between the source containers and the receiving container, means for measuring a quantity of transferred fluid, a monitor that determines the accuracy of the means for measuring, and means for preventing transfer of fluid unless the means for measuring is sufficiently accurate.

13 Claims, 8 Drawing Sheets

LOAD CELL AMPLIFIER
L.C.
400
+ REG
- DC
402
AMP
404
L.P.F.
406
SPAN
ADJ
ZERO ADJ
408
L.P.F.
412
TO A/D

M.B.S.
1.0MHZ
OSC
414
÷2
410
SC
420
6
6
422
8
8
430
DATA BUS
ASIG
413
LSB
EOC
EXTERNAL
I/D PORT, 304
430

DRIFT STABILIZATION CHECK

BACKGROUND OF THE INVENTION

The invention generally relates to systems for monitoring error in measuring apparatus. More particularly, the invention relates to weighing apparatus in systems for transferring fluids from individual source containers to a single receiving container. Yet more particularly, the invention relates to weighing apparatus in systems for transferring liquid drugs from individual vials, bottles, or bags to a single solution bottle or bag for administration to a patient.

In hospitals, it is frequently necessary to provide solutions for intravenous administration to a patient which contain a variety of drugs in a single solution container. A common example of such a need arises when a patient is receiving all of his nutritional needs intravenously. In this situation, the patient will typically receive a basic solution containing amino acids, dextrose, and fat emulsions which provide a major portion of the patient's nutritional needs. However, this solution is insufficient to maintain a patient for an extended period of time. Therefore, a typical total parenteral solution includes as many as eight to twelve additional additives. The additives are typically minute quantities of vitamins, minerals, electrolytes, etc. Therefore, when a pharmacist is preparing a solution for total parenteral nutrition, it is necessary for the pharmacist to individually add each of the additional additives to a solution container after the base solutions have been added. This is typically done with individual syringes and requires a relatively long "hands on" time on the part of a pharmacist to accurately add all additives to each of the required additives. Further, manual additive addition requires multiple entries into the patient container and volumetric quality control is difficult to maintain.

An automatic compounding device developed to assist a pharmacist in preparing solutions for total parenteral nutrition is described in U.S. Pat. Nos. 4,467,844 and 4,513,796 which are incorporated herein by reference. This device is used to assist the pharmacist in automatically compounding the base solution of amino acids, dextrose and fat emulsions. This system typically uses three or more peristaltic pumps to individually pump each of the base solutions from three or more separate source containers. Computer software also has been developed and is currently being used to program in the amount of solution required for a series of individual patients. This program is designed to operate the automated compounding equipment described in each of the above patents. This program is more fully described in U.S. patent application No. 665,268 filed Oct. 26, 1984, now U.S. Pat. No. 4,653,010 which is also incorporated herein in by reference.

While the above-described system has provided a tremendous advantage to the pharmacist, it is not useful for adding minute quantities of fluid additives to the receiving container. U.S. Pat. No. 4,789,014 discloses a device which can very accurately dispense very small quantities of fluids into a receiving container. U.S. Pat. No. 4,789,014 is fully incorporated herein.

In the device disclosed in U.S. Pat. No. 4,789,014, disposable transfer sets are removeably installed in the system to provide fluid conduits between various source fluid vials and a receiving container. A load cell is employed to measure quantities of fluids added to the receiving container.

The load cell can measure quantities on the order of a single droplet. As such, the load cell is highly sensitive.

After the installation of a transfer set, it is possible for a load cell of a compounding device such as that disclosed in U.S. Pat. No. 4,789,014 to be affected such that a significant margin of error can be present. However, this margin of error diminishes over time as the load cell stabilizes.

It would be advantageous to prevent operation of a device such as that disclosed in U.S. Pat. No. 4,789,014 until accurate load cell readings can be obtained so as to prevent erroneous measurement of fluids. Erroneous measurement of fluids can lead to the administration of incorrect doses of medication and the like, which may harm a patient.

SUMMARY OF THE INVENTION

The present invention provides a system for preventing operation of a device including a measuring system until sufficiently accurate measurement readings can be obtained. To this end, the invention provides a system for identifying error stabilization over time.

In an embodiment, the invention provides a system for monitoring readings obtained from a weighing apparatus and for identifying when error in such readings stabilizes below a preselected degree.

In another embodiment, the invention provides a compounding device including a system for monitoring a weighing apparatus employed to weigh various source materials to identify error in weight readings and stabilization of such error below a preselected degree.

In an embodiment, the system employs a ring buffer for successively storing a plurality of measurement readings made at preselected time intervals.

In another embodiment, the system includes a scheme for comparing the last measurement made with a measurement made a preselected number of time intervals previously.

A particular advantage of the invention is the provision of an improved compounding device including a system that can monitor accuracy of an associated measuring device so that the compounding device can be prevented from operating unless the accuracy of the measuring device is suitable.

These and other advantages, as well as other features, of the invention will become apparent from the following description of the preferred embodiments of the invention and the drawings.

DETAILED DESCRIPTION OF THE PRESENTLY PREFERRED EMBODIMENT

Figure 1:
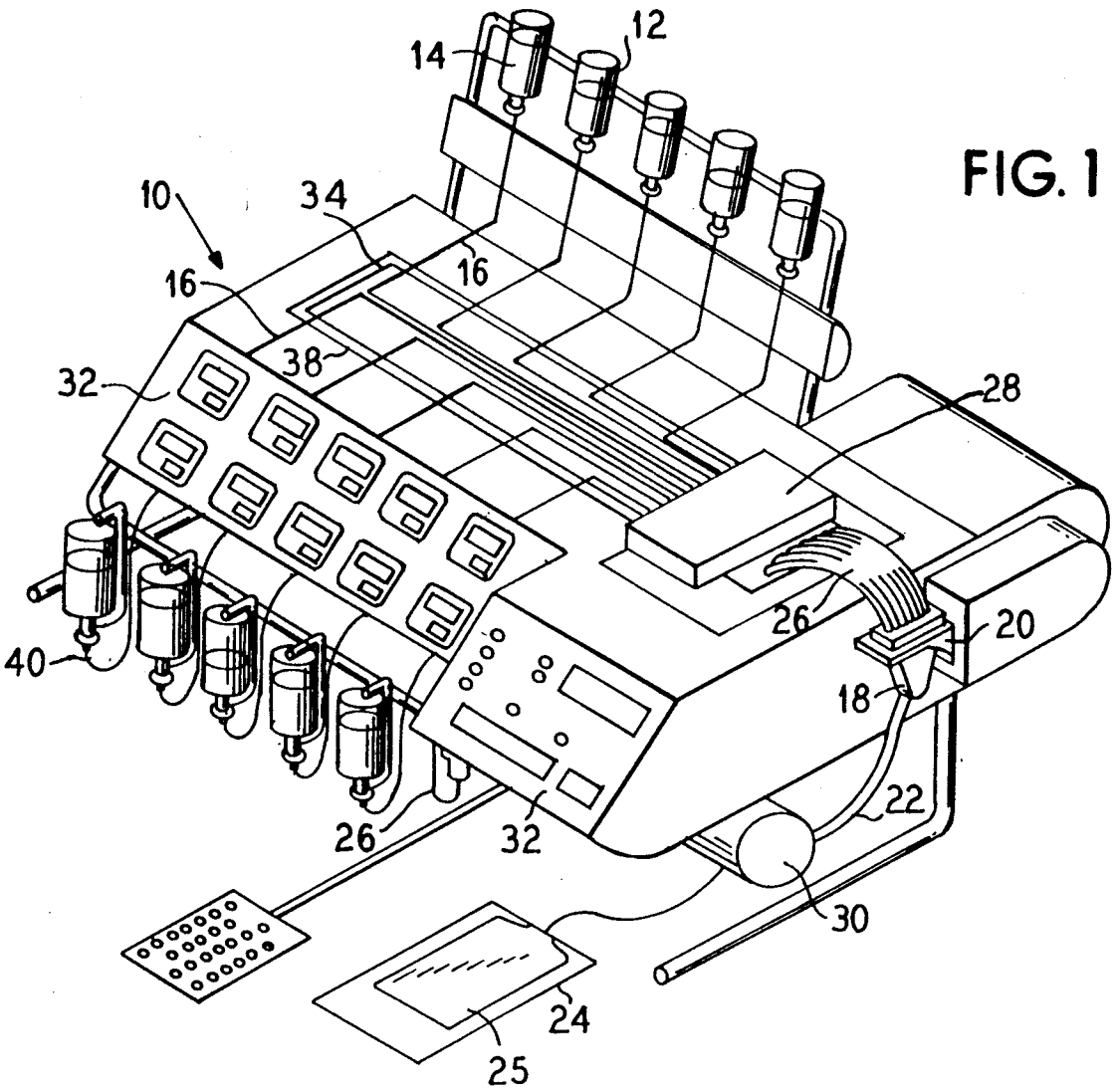
FIG. 1 is a perspective view of an embodiment of a compounding device.

FIG. 1 illustrates an embodiment of a compounding of device 10 for accurately transferring individual doses of separate fluids from individual source containers 12. Each individual source container may contain a different fluid 14. In some cases, the fluid in one container may be incompatible with fluids contained in other source containers. Fluid is transferred from each source container 12 through a separate individual fluid conduit 16 to a single chamber 18. The chamber 18 is suspended from a load cell 20. The load cell 20 constantly weighs the total weight of the chamber to develop an output signal which is indicative of the amount of fluid in the chamber 18 at any given time. The mechanical features of the device 10 are described more completely in U.S. Pat. No. 4,789,014 which is incorporated herein by reference.

The chamber 18 is provided with a single chamber fluid outlet conduit 22 which is in fluid communication with a single receiving container 24. In accordance with U.S. Pat. No. 4,789,014, the receiving container 24 may have been previously partially filled with a base solution 25 that can consist of amino acids, dextrose, and fat emulsions. However, it is not required that the receiving container contain any fluid prior to operation of the device.

The chamber 18 also includes a pressure conduit 26 which is in contact with a pressure means. In the preferred embodiment of the invention, the pressure means is a single peristaltic pump which will be discussed in greater detail below. The purpose of the pressure means is to selectively create positive and negative pressures in the chamber 18 during operation of the device to control the rate of fluid flow into and out of the chamber.

The device is further provided with a first occlusion means 28. The purpose of the first occlusion means is to selectively prevent fluid flow from each of the individual fluid conduits 16 from entering the chamber 18 in the absence of a command from a control means 32. During operation of the device, the first occlusion means 28 will only allow fluid to flow from one source container 12 to the chamber 18 at a time. In this manner, it is possible to very accurately monitor the amount of fluid flowing from each container into the chamber through the use of load cell 20.

The device further includes a second occlusion means 30 for selectively occluding fluid flow from the chamber outlet fluid conduit 22 to the receiving container 24. The second occlusion means 30 is a solenoid occluder.

The device is controlled by a control means 32 which controls the first and second occlusion means as well as the pressure means. The control means causes the first occlusion means to allow fluid flow through at least one of the individual fluid conduits 16 while causing the second occlusion means 30 to prevent fluid flow from the chamber 18 into the receiving container. The control means enhances fluid flow into the chamber 18 by creating a negative pressure in the chamber, thereby drawing fluid from the source container 12 through the individual conduit line 16 into the chamber. After the load cell 20 has sensed that the appropriate amount of fluid has entered the chamber 18 from a particular source container 12, the control means causes the first occlusion means 28 to prevent further fluid flow from that source container. At this point, the control means 32 may then either cause the first occlusion means 28 to allow fluid to flow from another source container into the chamber, or cause the second occlusion means 30 to open to allow fluid to flow from the chamber 18 into the receiving container 24.

The control means may allow a second fluid to flow into the chamber when a first fluid is still present in the chamber if the first and second fluids are compatible with each other and there is sufficient empty space remaining in the chamber to receive the entire amount of the second fluid to be dispensed. The control means will not allow a second fluid to enter the chamber when a first fluid is still present if the two fluids are incompatible with each other, or if insufficient room exists in the chamber. The control means 32 enhances fluid flow from the chamber 18 into the receiving container 24 by causing the pressure means to generate a positive pressure in pressure conduit 26 which is in fluid communication with the chamber 18. This causes a positive pressure in the chamber so that when the second occlusion means 30 is opened to allow fluid to flow from the chamber to the receiving container 24, the positive pressure will force the fluid out of the chamber and into the receiving container 24. This greatly reduces fluid retention in the chamber 18.

Figure 2:
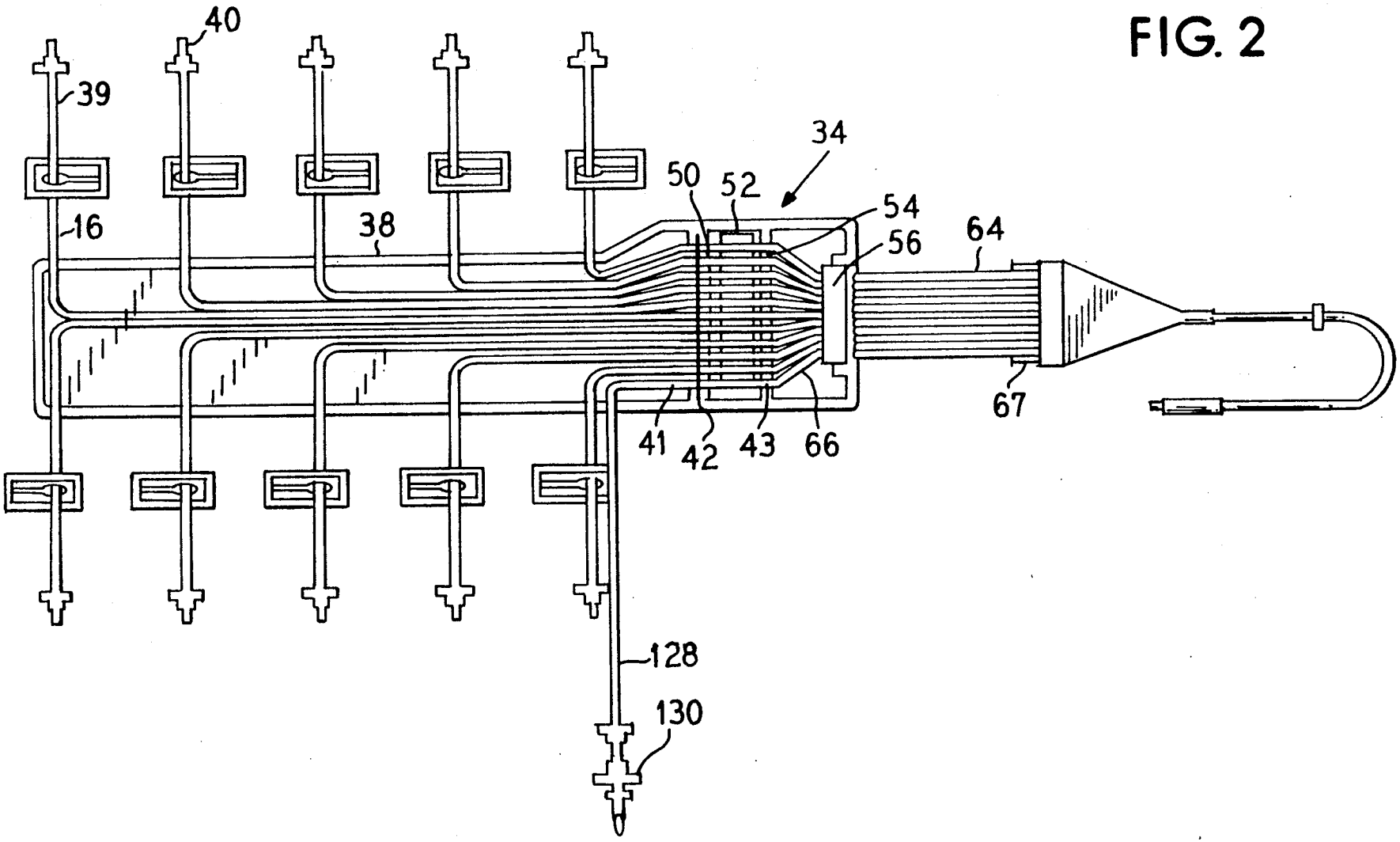
FIG. 2 is a plan view of a transfer set used in the device of FIG. 1.

Referring now to FIG. 2, a transfer set 34 is described in greater detail. The purpose of the transfer set is to transfer fluids from each of the individual containers 12 into the receiving container 24. As can be seen in FIG. 2, the transfer set 34 includes a plurality of individual fluid conduits 16. Each of the individual fluid conduits is formed of a flexible piece of tubing. Various materials can be used to make the flexible conduits such as polyvinylchloride (PVC) or polyethylene tubing. Polyethylene tubing may be desired when the device is used with drugs that are incompatible with PVC. A proximal end of each of the individual conduits 16 is mounted in a tray 38. The purpose of the tray is to maintain each conduit 16 in a spaced-apart relationship from the other conduits and to keep the tubes organized when the transfer set is being mounted onto the device 10. Preferably, the tray is a vacuum-formed plastic tray made of PVC or glyrol-modified polyethylene teraphthalate (PETG).

In an embodiment, the tray is specifically designed so that the distal end 39 of each fluid conduit 16 is positioned adjacent to the particular source container 12 to which the distal end 39 of the conduit 16 is to be connected. Referring again to FIG. 1, the individual conduit 16 exits tray 38 in such a manner that half of the individual conduits 16 are directed to one side of the device 10, while the other half of the individual conduits are directed downwardly to the other side of the device. Since the source containers in the preferred embodiment are disposed along both sides of the device 10, this greatly assists the pharmacist in insuring that the appropriate individual conduit 16 is connected to its respective container 12 when the transfer set is placed in the device 10.

An outlet conduit 22 is in fluid communication with the lowermost portion of the chamber in the preferred embodiment of the invention. Referring again to FIG. 1, the secondary occlusion means 30 is provided to prevent fluid flow from the chamber as the chamber is being filled.

As discussed above, the device 10 also includes a load cell 20 for sensing the amount of fluid in the chamber 18 during operation of the device and for generating weight signals relating to the amount of fluid in the chamber. The load cell includes sensing means in contact with the chamber 18. The details of the mechanical features of the load cell are more fully described in U.S. Pat. No. 4,789,014. However, for the purposes of this description, it should be noted that the load cell is connected to a chamber support which receives the chamber 18. The load cell senses the weight of the chamber 18 and generates weight signals which are indicative of the amount of fluid in the chamber. The signals are transmitted to the control means 32 for appropriate processing.

The operation of the device 10 is described in greater detail in the following description.

After a transfer set has been installed in the device, the operator generally is then ready to program the device to indicate the amount and type of each fluid to be transferred from each of the individual source containers into the receiving container. Information can be input into the device from one of two sources. One source of entering information into the device is a keyboard entry device. Another method of entering information into the device is through a computer terminal.

When the device 10 is turned on, a system of internal checks is automatically performed by the control means 32. In the preferred embodiment of the invention, two microprocessors are used in the control means 32. While a variety of microprocessors can be used, in one embodiment of the invention, an Intel 8031 microprocessor can be used for both of the microprocessors. One microprocessor serves as a master microprocessor and another microprocessor serves as a pumping control microprocessor. A simplified block diagram of a typical microprocessor is illustrated and described in U.S. Pat. No. 4,789,014.

During power up of the device 10, various diagnostic and other check routines can be performed simultaneously The diagnostics can include testing the internal random access memory of each microprocessor; testing an external memory attached to a microprocessor; initializations; and specialized checks of various other devices. A variety of routines are discussed in greater detail in U.S. Pat. No. 4,789,014.

All of the routines effected in the compounding device 10 are controlled by a pair of master control routines. Each microprocessor has its own master control routine to direct each microprocessor to the appropriate routine during operation of the device.

Figure 3:
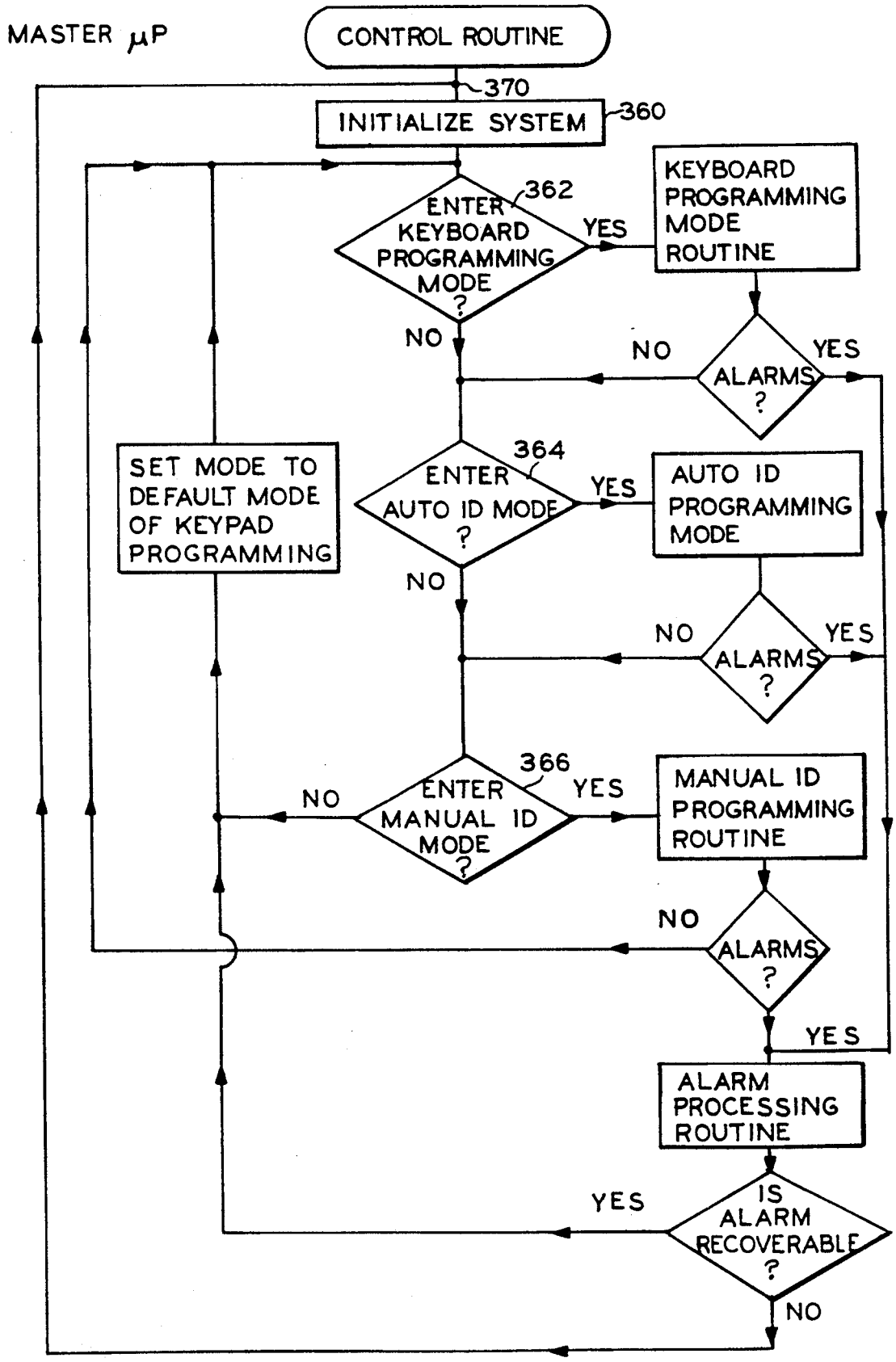
FIG. 3 is a flow chart illustrating a master control routine for the master microprocessor of the compounding device of FIG. 1.

The control routine for the master microprocessor is discussed in greater detail below with respect to FIG. 3. As can be seen in the figure, the first function performed by the master control routine is to initialize the system. This is illustrated by block 360. The initialization procedure has been discussed above in connection with the start-up of the device. After the master microprocessor has been initialized the master control routine next performs a check to determine if it is necessary to enter the keyboard programming mode. If it is not appropriate to enter the keyboard programming mode, the next check performed by the master control routine is to determine if it is appropriate to enter the auto identification mode.

The next check performed by the master routine is to determine if it is appropriate to enter the manual identification mode. If it has been determined during each of the three checks described above to enter into one of the various modes in which information is entered by an operator into the device, the master control routine will allow the information to be entered. However, as can be seen in FIG. 3, during this process, the master control routine is continuously checking for the presence of any alarms generated by the system. In the event that any alarm has been generated, the master control routine will cause the master microprocessor to enter into an alarm processing routine. If the alarm is one from which the device can easily be recovered from the appropriate action will be taken, and the master control routine will return to a default mode of keyboard programming in the preferred embodiment of the invention. If the alarm is not a "recoverable alarm", then the master control routine will cause the master microprocessor to return to the location designated by element 370 in FIG. 3.

The general programming of the microprocessor having been described, the interactions of the load cell and the microprocessor will now be described.

Figures 4A, 4B:
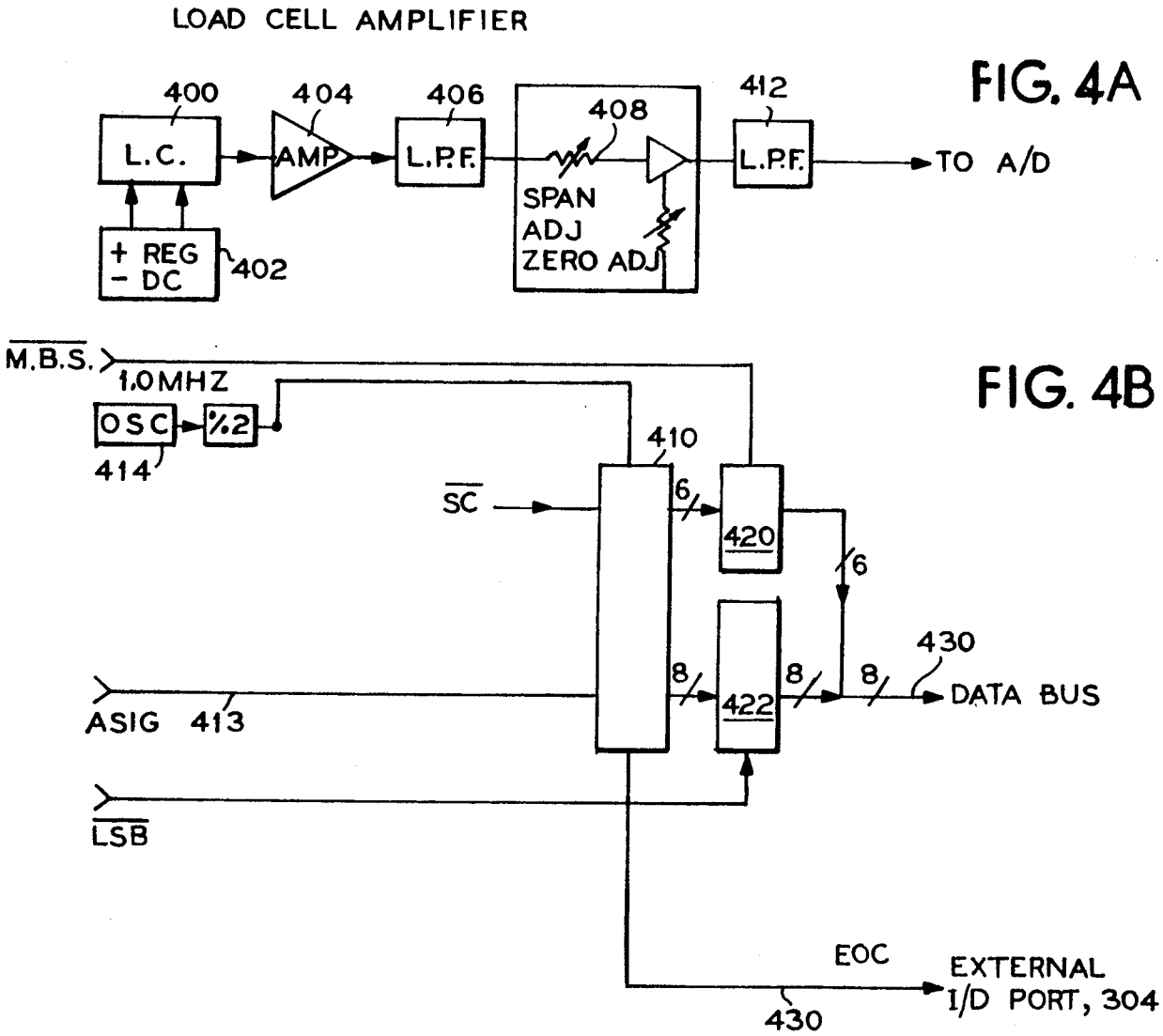
FIG. 4*a* is a block diagram of electronics of a loadcell amplifier of an embodiment of the invention.
FIG. 4*b* is a block diagram of the electronics of an A-D converter of an embodiment of the invention.

Referring now to FIG. 4*a* and 4*b*, a load cell 400 is powered by a regulated DC source 402. As discussed above, the chamber is suspended from a bracket on the load cell so that the load cell 400 generates an analog signal which is indicative of the weight of both the chamber and any fluid contained in the chamber. The load cell in an embodiment of the invention, is a shear-beam type load cell based on resistance strain gauge technology. Weight values are converted by the load cell into DC signal voltages. These voltages, or signals, are fed into a linear amplifier 404.

The signal generated by the load cell 400 is a relatively low level signal which requires amplification prior to transmission to an analog-to-digital converter. In an embodiment of the invention, the linear amplifier 404 is a commercially available integrated circuit, low-noise, low-drift instrumentation amplifier. The amplifier 404 provides the bulk of amplification needed to bring the low level signal from the load cell to a level adequate for input into the A/D converter.

The signal from amplifier 404 is passed through a low-pass filter 406. This filter serves to attenuate noise components generated by electromagnetic interference, semiconductors, seismic effects and load cell mechanical resonance. The signal is then passed from the low-pass filter 406 to a "span trim and zero adjust" stage 408. The span trim function of this stage is used to set the overall load cell amplifier gain (span) to a given millivolt/gram value required at the input to an A/D converter 410. The zero adjust function assures a unipolar signal input voltage to the A/D converter, which is configured in the unipolar mode. The signal is passed from the span trim and zero adjust stage to an additional low-pass filter 412. The function of low-pass filter 412 is essentially identical to the function of filter 406. The signal then passes to the A/D convertor 410 through line 412.

The signal is then passed through line 413 to A/D converter 410. The A/D conversion process is implemented by A/D converter 410 together with peripheral circuitry consisting of clock oscillator 414, and high and low data byte selection signals into gates 420 and 422. The A/D converter 410 converts the amplitude value of the signal from L.P.F. 412 to an equivalent 14-bit binary coded output signal. This signal is transmitted through gates 420 and 422 which sequentially place a high data byte and then a low data byte on data bus lines 430 to the I/0 ports of the pumping microprocessor. The information is then transmitted to a status buffer in internal ram 450 of the pumping microprocessor. Gates 420 and 422 transmit data to the microprocessor after the microprocessor senses the end of conversion signal via line 432 which is transmitted from A/D 410 to the I/O port 304 of the pumping up. After the low data byte has been transferred, the A/D conversion cycle is completed, and begins again with the arrival of the next start conversion pulse.

It can be appreciated that the sensitivity of the load cell 20 is quite high due to the fact that it is measuring differences in weight of the chamber 18 the accumulation of droplets of liquid. The load cell 20 must therefore recognize minute differences in weight.

Figure 5:
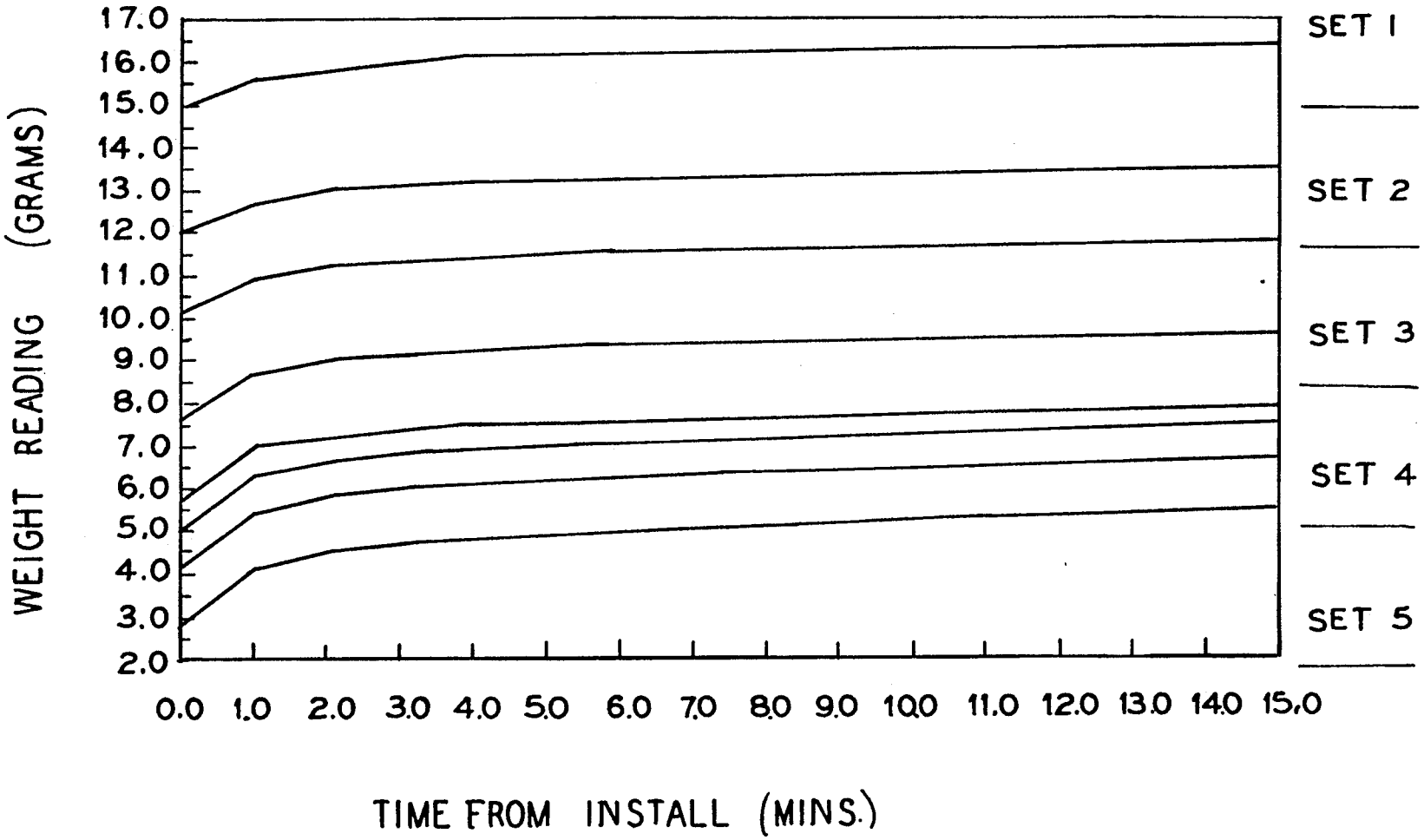
FIG. 5 is a graph that illustrates weight measurement drift stabilization over time for various transfer sets coupled to the device.

After the installation of a transfer set, the sensitivity of the load cell 20 can be affected such that there can be a significant drift in the weight readings thereof. This is illustrated best in FIG. 5 wherein weight readings are plotted over time after installation of various transfer sets. From FIG. 5, it can be seen that the weight readings may be in error by as much as 22% after a transfer set is initially installed. It can further be seen that the weight readings stabilize generally after about 1-15 minutes from the time of installation. Accordingly, it can be seen that compounding, i.e., mixing of solutions, should not take place for approximately 1-15 minutes after installation.

The present invention provides a routine that can be implemented via computer instructions or dedicated hardware for checking drift stabilization after a transfer set is installed and for preventing compounding if the drift is significant. A significant drift has been determined to be approximately 0.1 gram per minute which relates to an error of approximately 2%. A drift error greater than 2% is considered unacceptable.

Figure 6:
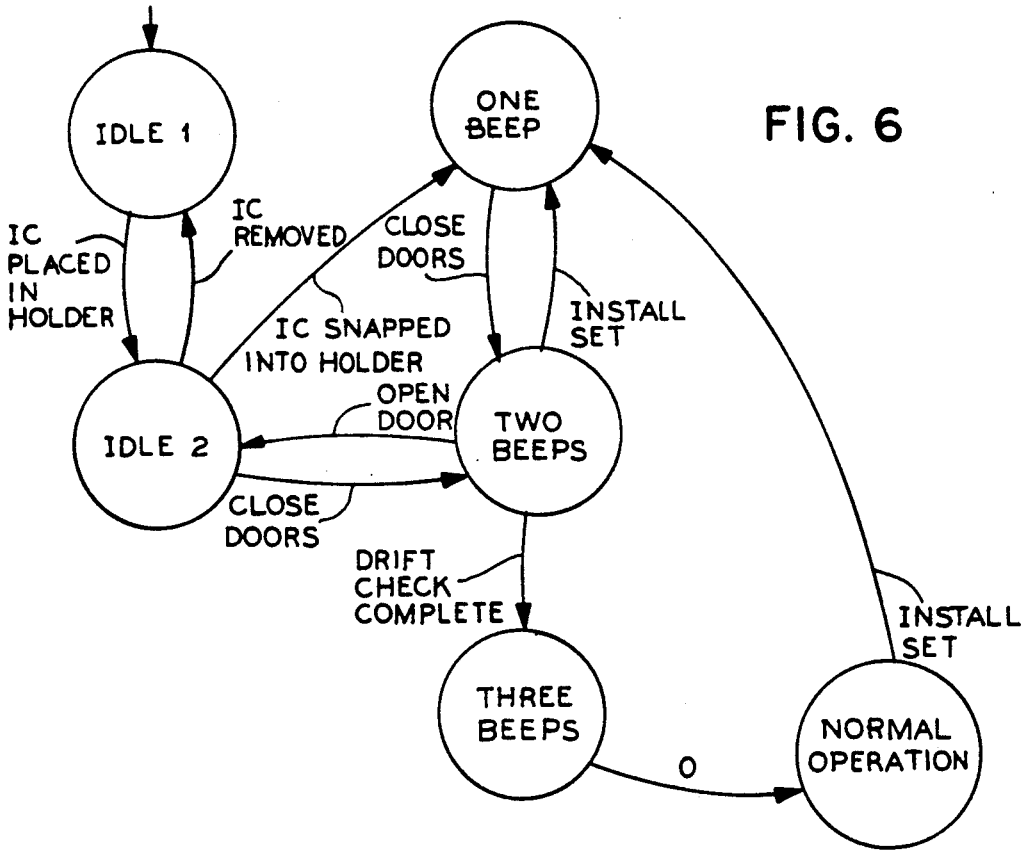
FIG. 6 is a logic state diagram for operation of the device of FIG. 1 for installation of a transfer set.

In FIG. 6 there is illustrated a logic state diagram that depicts a sequence of events required of an operator to commence normal operation of the device. Should an operator attempt a compounding cycle before the illustrated steps are completed, the device issues an excessive drift alarm. When the device recovers from the alarm, the routine commences its check all over again.

As illustrated, after a transfer set is installed during normal operation as illustrated at 500, and assuming the necessary integrated circuitry is installed, the device will sound one beep to indicate to an operator that the device is ready for the start of the drift stabilization test. Once all of the doors are closed, as indicated at 502, two audible beeps are provided to indicate to the operator the start of the drift stabilization check routine. The drift stabilization routine proceeds for a minimum of one minute and upon successful complete (a drift of less than preferably 0.1 gram/per minute), three audible beeps are provided to indicate that compounding may begin. At any point of time prior to this, an excessive drift alarm would be generated and the routine restarted if the start button is pressed.

Figure 7:
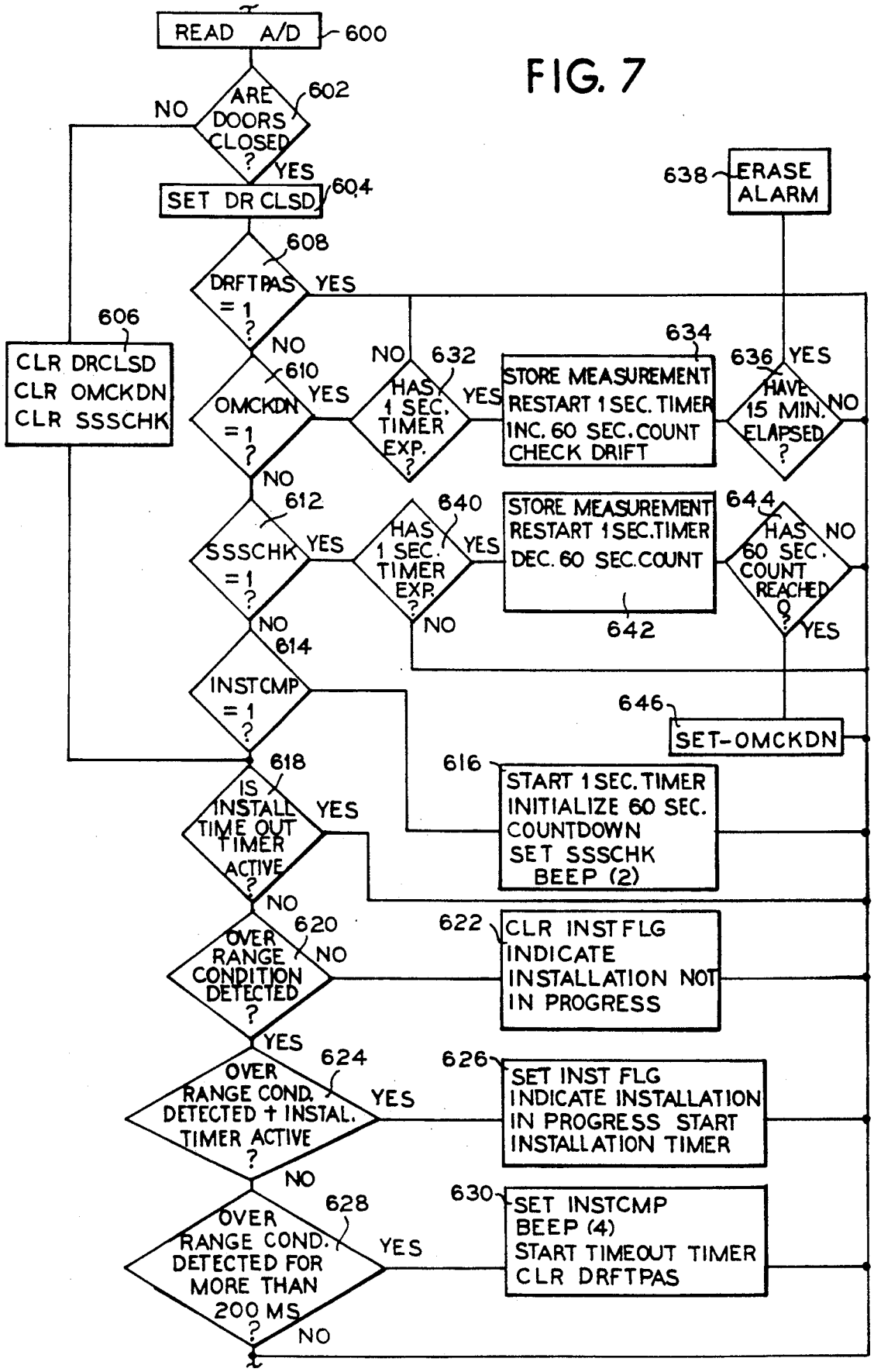
FIG. 7 is a flow chart of a routine performed by the control system of the device to obtain weight measurements and to effect the operation depict in the state diagram of FIG. 4.
Figure 8:
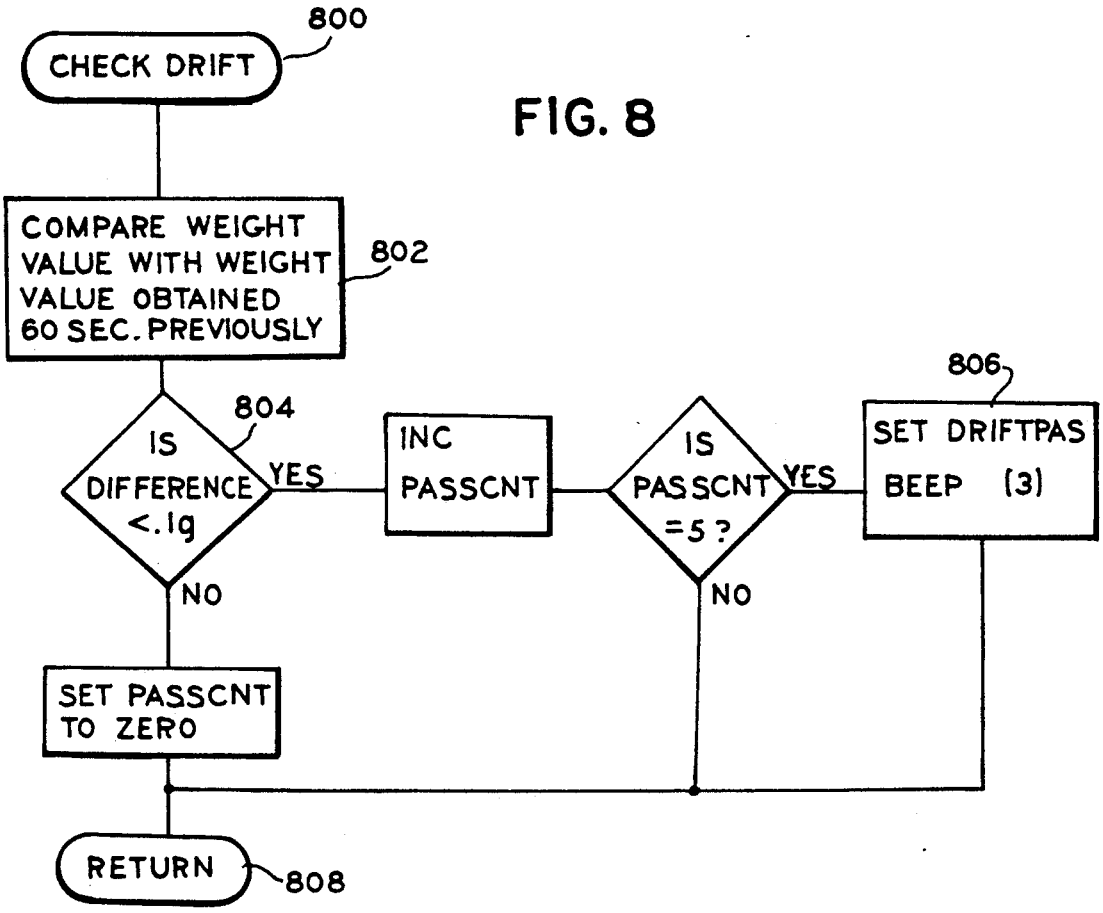
FIG. 8 is a flow chart of a drift stabilization check sub-routine performed by a microprocessor of the device.
Figure 9:
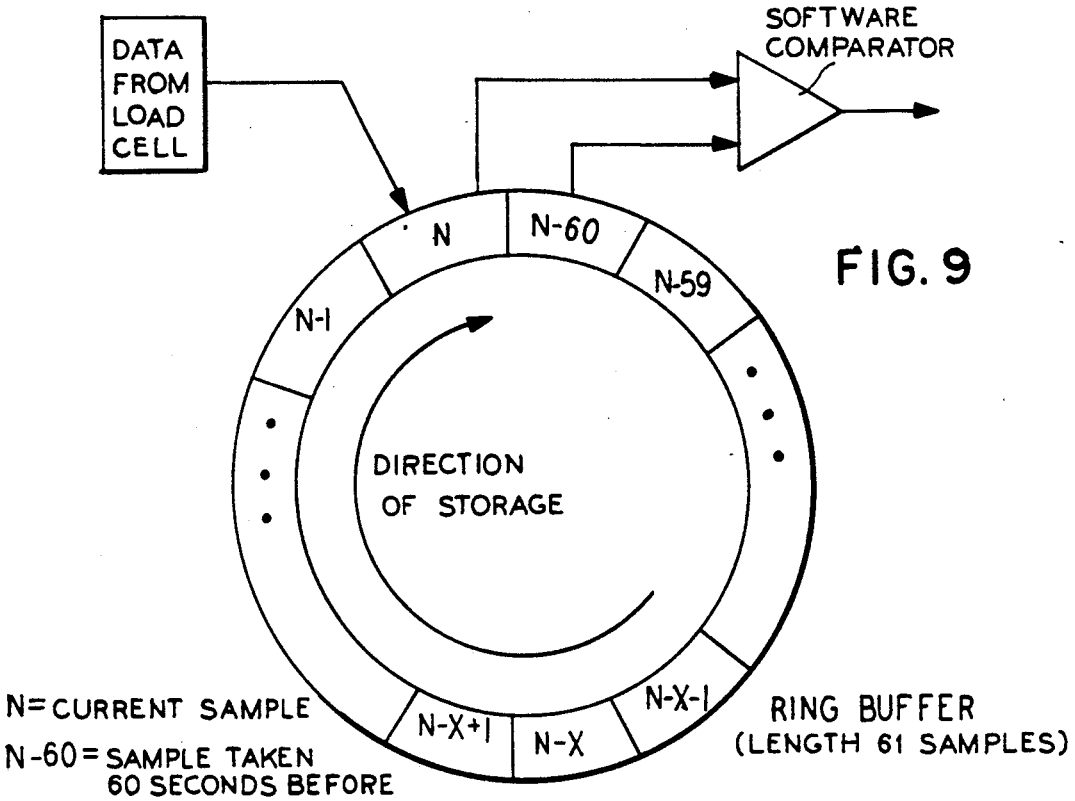
FIG. 9 is a schematic diagram illustrating a ring buffer employed in the routine of FIG. 4.

Routines executed by the control system to effectuate the foregoing are illustrated in flow chart form in FIGS. 7 and 8. The illustrated routines require the use of a ring buffer which is depicted in FIG. 9.

With respect to the flow chart of FIG. 7, several acronyms are used for various software flags that are set and interpreted during execution of the routine. "INSTFLG" relates to installation of a transfer set and a "true condition" indicates that installation of a transfer set has commenced. "INSTCMP" also relates to installation of a transfer set and a "true condition" indicates that installation of a transfer set has been completed. "DRCLSD" relates to the status of the doors of the device and a "true condition" indicates that all of the doors of the device are in a closed condition. "SSSCHK" relates to collection of sample measurement information and a "true condition" indicates that initial sampling of 60 seconds worth of load cell measurement information has commenced. "OMCHDM" relates to collection of samples of load cell measurement information and a "true condition" indicates that initial sampling of one minutes worth of load cell measurement information has been completed. "DRFTPAS" relates to drift of the weight measurements of the load cell and a "true condition" indicates that the drift has reached (i.e., decreased to) an acceptable limit.

Further with respect to the flow chart, several acronyms relating to instructions executed by the microprocessor are indicated. "INC" is a microprocessor instruction which commands the indicated variable to be incremented by the count of 1. "DEC" is an instruction that commands an indicated variable to be decremented by a count of 1. "SET" instructs the microprocessor to set an indicated flag to a true condition which, in the preferred embodiment, is a binary 1. "CLR" is an instruction to the microprocessor to set an indicated flag to a false condition, which in the preferred embodiment is a binary 0.

With the foregoing explanations, the flow charts of FIGS. 7 and 8 should be readily understood by those of ordinary skill in the relevant art with reference to the following description. Reference can also be made to U.S. Pat. No. 4,789,014.

In a preferred embodiment, during the execution of the routine, weight readings are taken from the load cell at approximately one second intervals and stored in the circular ring buffer. After 60 readings have been taken (approximately one minute's worth of readings), the routine commences to compare the latest reading with one taken 60 seconds previously. If the compared samples are within 0.1 grams of each other, for five (5) successive readings, the routine determines that the drift has stabilized and normal operation of the device can begin. If the readings are not within about 0.1 gram of each other, the current weight is stored for future comparison.

It can be appreciated that the foregoing procedure can be expressed more generically. To that end, it can be stated that successive weight measurements are made at preselected intervals and stored in a ring buffer. The last measurement made is compared with the oldest measurement in the ring buffer. If the comparison indicates that drift has stabilized, then the device is permitted to operate.

The ring buffer preferably includes a sufficient number of storage locations to store measurement information for all intervals over a minimum amount of time determined to be necessary to effect the comparisons discussed above. Accordingly, if, as is preferred, measurements are to be made at one second intervals, and at least one minute must elapse before comparisons can begin, then the ring buffer should have 61 storage locations (i.e., minimum time÷interval+1). The comparison will thus be between the measurement in the N+1 storage location and the first storage location, where N is an integer equal to the minimum amount of time required to effect the comparison divided by the interval between measurements.

Specifically with reference to FIG. 7, the flow chart represents instructions executed by the slave microprocessor of the control system as part of its hold routine while it is in a so-called "wait state," i.e., no particular action is being taken such as pumping. The preferred hold routine is discussed in detail in U.S. Pat. No. 4,789,014. It can be appreciated that these instructions comprise a portion of the overall hold routine which is cyclically executed.

As a first step 600, the pertinent portion of the routine effects a read of the analog to digital converter of the load cell 20. As a second step 602, the routine effects a read of the sensors associated with the doors of the device 10 to determine if they are closed. If the doors are closed, then, in a step 604, the routine sets the "DRCLSD" flag. Alternatively, if the doors are not closed, then, in a step 606, the routine effects a clear of the "DRCLSD", "OMCKDN" and "SSSCHK" flags, and then proceeds to skip various instructions in the routine, as indicated.

Once the step 604 is performed, the routine proceeds to step 608 and determines if the "DRFTPAS" flag has been set. If the flag has been set, this indicates that a stable drifting has been detected and the remainder of the illustrated portion of the hold routine is ignored. If a stable drift condition has not been detected, then the routine proceeds to step 610 wherein it is determined if approximately one minute's worth of weight readings have been obtained. This determination is made by determining if the "OMCKDN" flag is set to 1.

If one minute's worth data has been obtained, then the routine proceeds to step 612 wherein it is determined if sampling of 60 seconds worth of load cell information has been requested. This is accomplished by determining if the "SSSCHK" flag is set. If the flag is not set, then the routine proceeds to step 614 wherein it is determined if installation of a transfer set is complete. This is accomplished by determining if the "INSTCMP" flag has been set to 1.

If the installation is not complete, then at step 618 the routine determines if a 2 second installation time-out timer is active. If the timer is active, steps 620 through 630 are ignored until the timer expires. If the timer is not active, then the routine proceeds to step 620 wherein it is determined if an over-range condition is detected.

In a separate routine, the analog-to-digital converter reading circuitry continuously determines if the readings are too high, i.e, in over-range. Accordingly, an appropriate flag is set whenever such an over-range condition is identified.

If an over-range condition is not detected at 620, the routine proceeds to step 622 and proceeds to clear the installation flag "INSTFLG" to indicate that an installation of a transfer set is not in progress. Subsequently, the remainder of the routine instruction are ignored until the overall hold routine is repeated.

If an over-range condition is detected at step 620, then the routine proceeds to step 624 wherein it is determined again if an over-range condition is detected and whether the installation timer is still active. If both conditions are true, then the routine proceeds to 626 at which time the installation flag "INSTFLG" is set to indicate that installation of a transfer set is in progress and the installation timer is restarted. Subsequently, the remainder of this portion of the routine instructions are ignored until the overall hold routine is re-executed.

If one of the conditions at step 624 is not true, then the routine proceeds to step 628 where the routine determines if an over-range condition has been detected for more than 200 milliseconds. If this is not true, then the remainder of this portion of the routine instructions are ignored and the hold routine continues. However, if an over-range condition has been detected for more than 200 milliseconds, then the routine proceeds to step 630 at which time, the installation complete flag "INSTLMP" is set, the drift pass flag "DRFTPAS" is cleared, and the time-out timer is started. Additionally, a single beep is generated to indicate that installation is complete.

Referring back to step 610, if one minute has elapsed, indicating that one minutes worth of data has been obtained, then the routine proceeds to step 632. At step 632, it is determined if a one second timer has expired. If the one second timer has expired, then the routine proceeds to step 634 where the weight measurement read at step 600 is stored in the next available storage location of the ring buffer illustrated in FIG. 9. At the same time, the one second timer is restarted and a 60 second count is incremented by 1. Further, the "check drift" subroutine of FIG. 8 is executed. The routine then proceeds to step 636.

At step 636, the routine determines if 15 minutes overall have elapsed. This is an overall check made to determine if too much time had elapsed. If 15 minutes have elapsed then the routine proceeds to step 638 wherein an appropriate alarm is issued.

If 15 minutes have not elapsed then the routine ignores the remaining instructions of the remainder of the illustrated portion of the hold routine until the overall hold routine is re-executed.

With respect to step 612, if it is determined that the start of sampling of 60 seconds of load cell information has commenced, then the routine proceeds to step 640. At step 640 it is determined if a one second timer has expired. If the timer has not expired then the remaining instructions of the illustrated portion of the routine are ignored until the overall hold routine is re-executed.

If it is determined that the one second time has expired at step 640, the routine proceeds to step 642. At step 642, the routine stores the weight measurements read at step 600 and restarts the one second timer. At the same time, the routine effects a decrement of the 60 second count. After all of the instructions at step 642 have been completed then the routine proceeds to step 644.

At step 644, the routine determines if the 60 second count has been decremented to zero. If the 60 second count has not been decremented to zero then the remaining instructions of the illustrated portion of the routine are ignored until the overall hold routine is re-executed. However, if the 60 second count has been decremented to zero, then the routine proceeds to step 646.

At step 646, the routine sets the "OMCKDN" flag to indicate that the initial sampling of one minute's worth of load cell data is complete. The routine then ignores the remaining instructions of the illustrated portion of the routine until the overall hold routine is re-executed.

In FIG. 8, the "check drift" sub-routine is illustrated. It will be recalled that the execution of a check drift sub-routine is requested at step 634. At the time that the check drift sub-routine is requested, the control system proceeds to call the sub-routine as illustrated at step 800. The sub-routine then proceeds to step 802 at which time the current weight measurement read at step 600 is compared with a weight measurement value obtained 60 seconds previously and which has been stored in the ring buffer of FIG. 9. The sub-routine then proceeds to step 804.

At step 804, it is determined if the difference between the two weight values compared at step 802 is less than 0.1 grams. If the difference is not less than 0.1 gram, then the "DRFTPAS" flag cannot be set. Accordingly, the sub-routine proceeds to step 808 at which time the routine effects a return back to the step 634.

If at step 804, a difference of less than 0.1 gram is identified, then the sub-routine proceeds to step 806. At step 806, the "DRFTPAS" flag is set inasmuch as a sufficiently small difference is detected. The control system also generates 3 beep tones to indicate that the device has passed the drift check procedure. Subsequently, the sub-routine proceeds to step 808 to return to step 634 of the hold routine.

Although the invention has been described and illustrated in detail, it is to be clearly understood that the same is by way of illustration and example only, and is not to be taken by way of limitation; the spirit and scope of this invention being limited only by the terms of the appended claims.

We claim as our invention:

1. A device for accurately transferring fluids from a plurality of source containers to a receiving container, comprising:

a removable transfer set providing fluid communication between the plurality of source containers and the receiving container;

means for measuring quantities of transferred fluids;

monitoring means for determining whether the means for measuring can measure within a preselected degree of certainty; and means for preventing transfer of fluid after installation of the transfer est until the means for measuring can measure within the preselected degree of certainty.

2. The device of claim 1, wherein the monitoring means obtains a plurality of measurements made at successive equal intervals of time and stores the plurality of measurements in the order in which the plurality of measurements were obtained.

3. The device of claim 2, wherein the monitoring means includes means for comparing the last measurement obtained with a measurement obtained at a preselected number of intervals previously.

4. The device of claim 3, wherein the interval of time is approximately one second and the preselected number of previous time intervals is sixty.

5. The device of claim 2, including a ring buffer, wherein the monitoring means stores the plurality of measurements obtained in said ring buffer.

6. The device of claim 1, wherein the monitoring means determines the accuracy of the means for measuring and wherein the means for preventing transfer or fluid after installation of the transfer set prevents transfer of fluid until the means for measuring can measure with sufficient accuracy.

7. A device for accurately transferring one or more fluids from one or more source containers to a receiving container via a removable transfer set, the device including means for preventing transfer of a fluid following installation of the transfer set until the quantity of the fluid can be measured with adequate accuracy, the means for preventing transfer of a fluid including means for measuring quantities of fluids transferred, and a monitor that determines whether the means for measuring can measure within a preselected degree of certainty.

8. The device of claim 7, wherein the means for preventing transfer of a fluid comprises a microprocessor programmed to obtain a plurality of successive measurements at preselected equal intervals of time and a ring buffer to store the plurality of measurements therein in the order in which the plurality of measurements were obtained.

9. The device of claim 7, wherein the means for preventing transfer of fluid comprises a microprocessor that is programmed to obtain first and second measurements at points in time separated by one or more preselected equal intervals of time and to compare the first and second measurements to identify any difference therebetween.

10. The device of claim 9, including a ring buffer to store the plurality of measurements therein and the ring buffer includes $N+1$ storage locations, N being an integer equal to a preselected time period divided by the equal intervals of time, and wherein the first measurement corresponds to the most recently stored measurement and the second measurement corresponds to a previously stored measurement.

11. The device of claim 10, wherein the interval of time is approximately one second.

12. The device of claim 10, wherein the second measurement is a measurement stored $N+1$ time intervals previously.

13. The device of claim 7, wherein the monitor determines the accuracy of the means for measuring.

* * * * *